United States Patent [19]

Bell et al.

[11] 4,230,371

[45] Oct. 28, 1980

[54] EQUIPMENT FOR LAYING A LAYER OF ELONGATE MATERIAL

[75] Inventors: Roy L. Bell; Dennis A. Gillard, both of Burton-on-Trent; Peter Watt, Newark; Brian Cartledge, Codnor; Barry Millhouse, Stonebroom; Michael E. Cheese, Underwood; Eric Dring, Pleasley, all of England

[73] Assignee: Coal Industry Limited, London, England

[21] Appl. No.: 27,699

[22] Filed: Apr. 6, 1979

[30] Foreign Application Priority Data

Apr. 11, 1978 [GB] United Kingdom ..... 14197/78

[51] Int. Cl.[2] ..... E21C 35/20; E21D 19/02

[52] U.S. Cl. ..... 299/33; 299/43; 405/150; 242/86.52

[58] Field of Search ..... 299/11, 33, 43, 45; 405/150, 288; 242/86.52, 86.6

[56] References Cited

U.S. PATENT DOCUMENTS

| | | | |
|---|---|---|---|
| 3,399,927 | 9/1968 | Groetschel | 299/11 |
| 4,099,785 | 7/1978 | Groetschel | 299/33 X |
| 4,122,682 | 10/1978 | Groetschel | 405/150 |

FOREIGN PATENT DOCUMENTS

| | | | |
|---|---|---|---|
| 605013 | 4/1978 | U.S.S.R. | 299/33 |

*Primary Examiner*—Ernest R. Purser
*Attorney, Agent, or Firm*—James Creighton Wray

[57] ABSTRACT

Equipment for laying a layer of elongate material adjacent to a newly exposed rock or mineral surface formed by a mining machine cutter as the machine traverses along the working face, a loading member for cut rock or mineral being positioned adjacent to the rear of the cutter, comprises a support bracket secured to the rear of the members, arm means pivotally mounted on the support bracket and supporting a store of elongate material, and means for urging the arm towards the newly exposed rock or mineral surface such that in use elongate material is dispensed from the store and laid adjacent to the newly exposed surface.

6 Claims, 12 Drawing Figures

EQUIPMENT FOR LAYING A LAYER OF ELONGATE MATERIAL

This invention relates to equipment for laying a layer of elongate material, for example, wire mesh or wire mesh with a sheet backing adjacent to an exposed rock or mineral surface in an underground mine.

In particular, the present invention relates to such equipment securable to a mining machine including a cutter for cutting rock or mineral from a working face and a loading member positionable adjacent to the rear of the cutter for urging cut rock or mineral towards a conveyor arranged along the working face, the equipment laying the layer of elongate material adjacent to the rock or mineral surface newly exposed by the cutter as it traverses along the working face.

Previously, it has been proposed to mount equipment for laying a layer of wire mesh adjacent to an exposed mine roof on the body of the mining machine, the equipment being cantilevered from the body of the machine into the newly formed track left directly behind the cutter. Unfortunately, such known equipment suffered from the disadvantage that it was only suitable for mining machines where the cutter preceded the machine body during the traverse of the machine along the working face. As it is frequent practice to have a cutter trailing behind the machine body such known equipment has tended to be unsuitable for many installations and, therefore, it has tended to be little exploited.

An object of the present invention is to provide equipment for laying a layer of elongate material which tends to overcome or reduce the above mentioned disadvantage and which can be used with a mining machine having a cutter which trails behind the machine body during the machine's traverse along the working face.

According to the present invention, equipment for laying a layer of elongate material adjacent to a newly exposed rock or mineral surface formed by a mining machine cutter as the machine traverses along the working face, a loading member for cut rock or mineral being positioned adjacent to the rear of the cutter, comprises support bracket means fixedly securable to the loading member arm means pivotally mounted on the support bracket means and constituting support means for a store of elongate material, and means for urging the arm means towards said newly exposed rock or mineral surface formed by the mining machine cutter such that in use as the machine traverses along the working face elongate material is dispensed from the store and laid adjacent to the newly exposed rock or mineral surface.

Preferably, said means for urging the arm means towards said newly exposed rock or mineral surface comprises resilient means.

Advantageously, said means for urging the arm means towards said newly exposed rock or mineral surface comprises a pawl and ratchet mechanism.

Advantageously, said means for urging the arm means towards the newly exposed rock or mineral surface comprises a piston and cylinder arrangement.

Advantageously, said means for urging the arm means towards the newly exposed rock or mineral surface acts between the support bracket means and the arm means.

Alternatively, said means for urging the arm means towards the newly exposed rock or mineral surface acts between the arm means and further support brackets means fixedly securable to the loading member at a location remote from the first mentioned support bracket means.

By way of example only, five embodiments of the present invention will be described with reference to the accompanying drawings, in which FIG. 1 is a side view of equipment for laying a layer of elongate material adjacent to a newly exposed mine roof on a longwall face of an underground mine, the equipment being shown in an operational position and being constructed in accordance with a first embodiment of the present invention;

Figure 1:
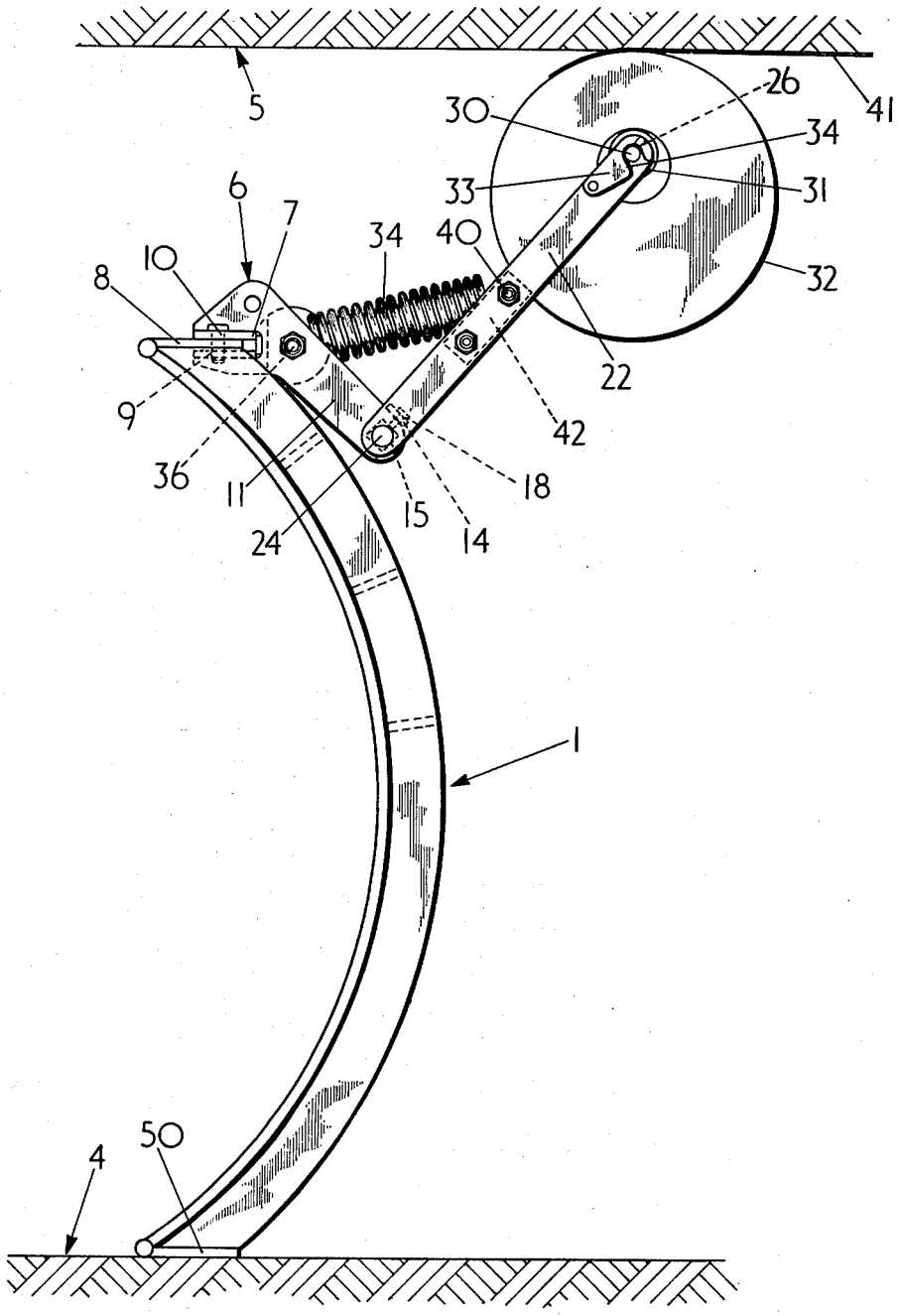
Figure 2:
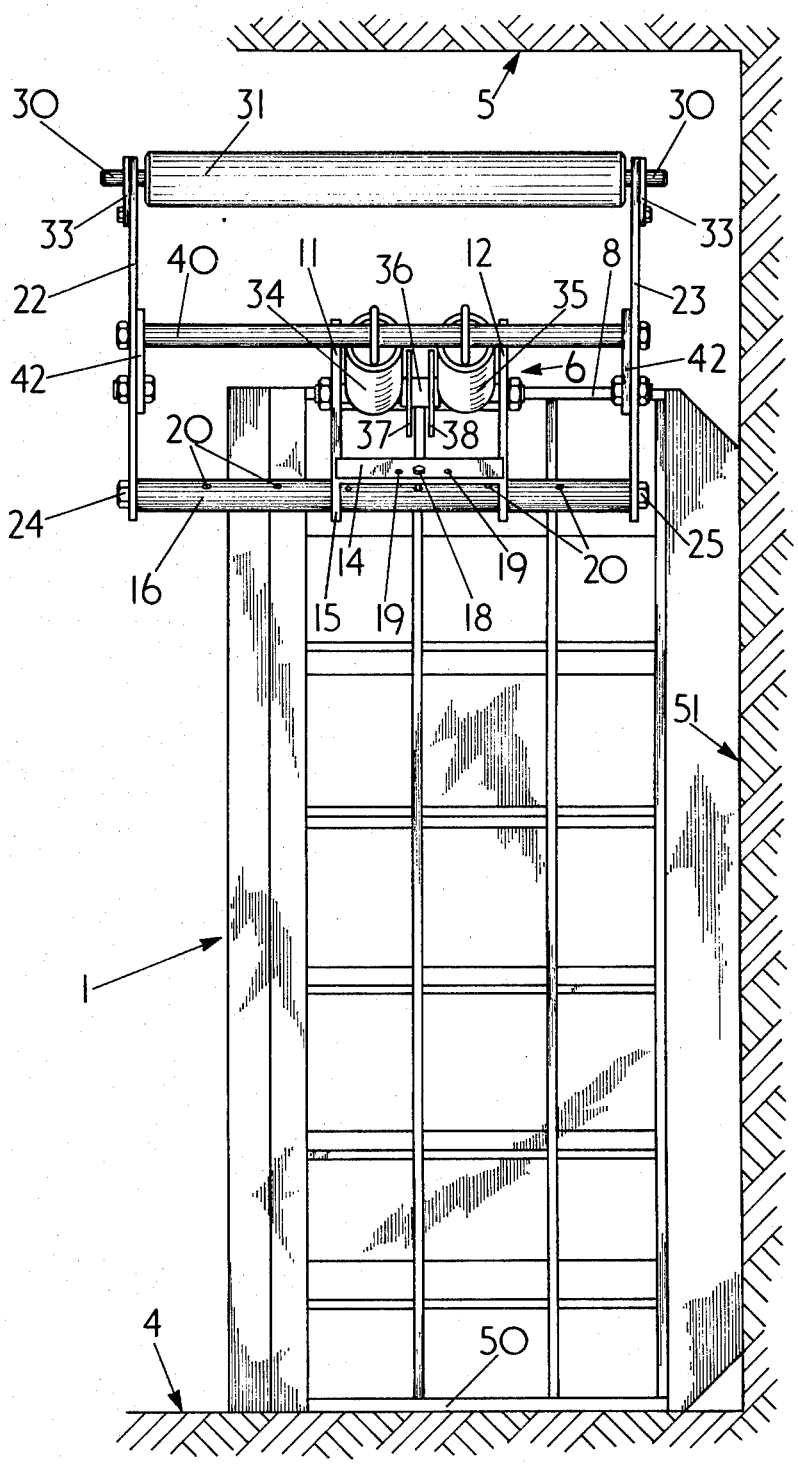
FIG. 2 is a rear end view of the equipment of FIG. 1.

FIGS. 1 and 2 of the drawings show a loading member in the form of a curved cowl 1 which is attached by arms (not shown) to a swivel support on a well known shearer mining machine having a rotary cutter arranged to cut rock or mineral from a working face as the machine traverses along a working face, the cowl 1 being mounted adjacent to the rear of the rotary cutter and co-operating with loading vanes provided on the rotary cutter to urge the cut rock or mineral towards a conveyor extending along the working face.

As the machine traverses along the working face the cowl 1 is slid along the newly formed mine floor 4 left directly behind the cutter. The upper portion of the cowl is adjacent to the newly formed mine roof 5 left directly behind the cutter.

The cowl is provided with a first embodiment of equipment for laying a layer of elongate material, for example, wire mesh or wire mesh with a sheet backing, adjacent to the newly exposed rock or mineral mine roof 5.

The equipment includes support bracket means comprising an adaptor 6 having a horizontally extending fork formation 7 for engagement with a horizontally extending flange 8 on the uppermost end margin of the cowl 1, bolts or pegs 10 being provided in bolt holes 9 to fixedly secure the fork formation to the flange 8. The adaptor 6 also includes a downwardly extending arm assembly comprising two arms 11 and 12 linked together by the fork formation 7 and by a cross member 14.

The lower margin of each arm 11 and 12 is provided with a square or rectangular hole 15 for slidably accommodating a square or rectangular bar 16. The bar 16 is non-rotatable in the holes 15 but is slidable in the direction of its longitudinal axis with respect to the holes, the bar is retained in a desired position relative to the arms 11 and 12 by means of a pin 18 which engages in an appropriate pin hole 19 provided in the cross member 14 and in an appropriate aligned pin hole 20 of a series of pin holes provided in the bar 16. The significance of this slide adjustment will be made clear later in this specification.

The equipment also comprises two upwardly extending arms 22 and 23 pivotally mounted adjacent their lowermost ends on to the ends of the bar 16 by means of two end bolts 24 and 25. The upper end margins of the upwardly extending arms 22 and 23 are provided with vertically extending slots 26 for accommodating the associated ends 30 of a roller or spindle 31 threaded through the central hole of a coil 32 of elongate material for example, wire mesh or wire mesh with a sheet backing. The coil 32 is omitted in FIG. 2. Pivotally mounted sliders 33 having downwardly extending slots 34 for engagement with the ends of the axle 30 are provided to retain the axle within the slots 26.

The equipment also comprises means for urging the arms 22 and 23 upwards towards the newly exposed rock or mineral mine roof 5, said means including two parallel resilient coil springs 34 and 35 mounted at one end on a cross element 36 fixedly secured at its ends to the two adaptors 6 and adjacent its centre region to two lugs 37 and 38. The other end of each spring 34, 35 is mounted on a cross bar 40 fixedly secured at its ends to the two arms 22 and 23 which are reinforced at the region where they support the bar 40 by two strengthening plates 42 fixedly bolted to the associated arms 22, 23. The action of the coil springs 34, 35 is to urge the arms 22, 23 to pivot about the axis of the bar 16 tending to maintain the coil 32 of elongate material adjacent to the mine roof and enabling a layer 41 of material to be layed adjacent the mine roof 5 as the machine traverses along the working.

If, as the machine traverses along the working face a piece of broken rock or mineral should fall from the mine roof onto the equipment, the arms 22, 23 are urged to pivot downwards against the action of the springs 34, 35 until the piece of rock or mineral is clear of the equipment. Then, the arms 22, 23 are urged by the springs 34, 35 back into their desired operative positions maintaining the coil 32 of elongate material adjacent to the mine roof 5.

When the machine reaches the end of its traverse along the working face the equipment is detached from the cowl 1 by removing the bolts 10 before the cowl is swung to the opposite side of the rotary cutter ready for the machine to traverse along the working face in the opposite direction to that just described. Before the machine starts in traverse in the opposite direction the equipment is first remounted on the rear of the cowl, the fork formation 7 being engaged on the flange 50 of the cowl 1 which is now uppermost, the slide arrangement associated with the bar 16 and the holes 15 enables the coil to be moved sideways along its axis until it is in a desired position relative to the rock or mineral wall 51. The pin 18 is then located in appropriate aligned pin holes 19 and 20 to fixedly retain the coil in the desired position. The machine then transverses back along the working face laying another layer of elongate material adjacent to the mine roof 5.

In an alternative installation including a mining machine having leading and trailing rotary cutter the dispensing equipment is always mounted on the cowl associated with the currently trailing cutter. Thus, upon the machine reaching the end of a traverse along the working face the dispensing equipment is detached from the trailing cowl on the just completed traverse and is mounted on the rear of the other cowl associated with the cutter which will be trailing on the next traverse along the working face in the opposite direction.

Immediately the elongate material is dispensed from the coil it is supported and retained adjacent the mine roof 5 by roof supports which are advanced immediately following the passage of the machine and/or by attaching the edge of the layer of elongate material currently being laid to the adjacent edge of the previously laid layer of elongate material.

When the machine reaches the end of its traverse back along the working face the cowl and dispensing equipment are once again set up as previously described with reference to the FIGS. 1 and 2 of the drawings ready for the next cutting transverse of the machine along the working face.

In other installations the machine may be flitted back along the working face and in which case a layer of elongate material is laid only on the cutting traverse of the machine.

From the above description it will be appreciated that the present invention provides simple, convenient and robust equipment for laying a layer of elongate material along a newly exposed mine roof so that an effectively continuous curtain of, for example, wire mesh or wire mesh with a sheet backing is provided over the mine roof. Thus, friable mine roof tends to be contained and broken rock or mineral tends to be prevented from falling into the travelling passage defined by the roof supports.

Figure 3:
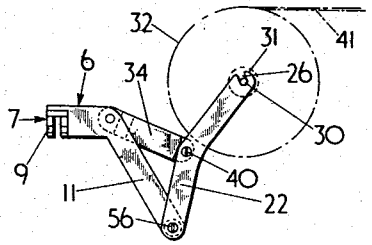
FIG. 3 is a side view of a second embodiment of equipment constructed in accordance with the present invention.
Figure 4:
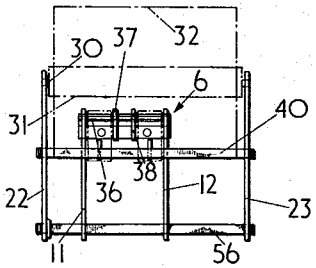
FIG. 4 is a rear end view of the equipment of FIG. 3.
Figure 5:
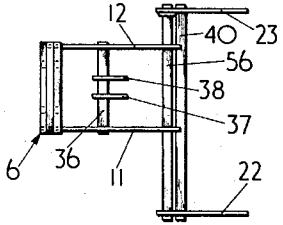
FIG. 5 is a plan of the equipment of FIG. 3.

FIGS. 3, 4 and 5 show a second embodiment of dispensing equipment which is somewhat similar to that previously described with reference to FIGS. 1 and 2 and the same reference numbers have been used for similar items.

The second embodiment of dispensing equipment is usually suitable for mounting only on one side of a cowl (which is not shown in FIGS. 3, 4 and 5). This is because no slide arrangement is provided for adjusting the position of the coil relatively to the working face. However, it is foreseen that some small sideways adjustment can be obtained by having a series of bolt holes (not shown) formed in the coal flange for engagement by bolts accommodated in bolt holes 9 provided in a fork formation 7 of adaptor 6 constituting support bracket means. It will be noted that the fork formation 7 is adapted to engage an upwardly extending cowl flange.

Like the first described embodiment, the second embodiment comprises an articulated arm means 11, 12, 22 and 23 and two resilient coil springs means 34 (not shown in FIGS. 4 and 5) for urging the arm means towards the newly exposed rock or mineral surface formed by the mining machine cutter such that in use as the machine traverses along the working face elongate material is dispensed from a store coil 32 (not shown in FIG. 5) and laid adjacent to the newly exposed rock or mineral surface.

In the case of the second embodiment a cross bar 56 is fixedly secured to the two arms 11 and 12 and a previously mentioned no sliding facility is provided. As with the first described embodiment the two upwardly extending arms 22 and 23 are pivotally mounted on the ends of the cross bar.

The operation of the second embodiment is similar to the first described embodiment except the dispenser equipment is used to lay a layer of elongate material in one direction of traverse only.

In modifications of the second described embodiment the cross bar 56 is engaged symmetrically by the two arms 11 and 12 and in this case the dispenser equipment is suitable for use in both directions of machine traverse along the working face any desired sideways adjustment of the coil being permitted by varying the position of the adaptor 6 along the cowl flange.

Figure 6:
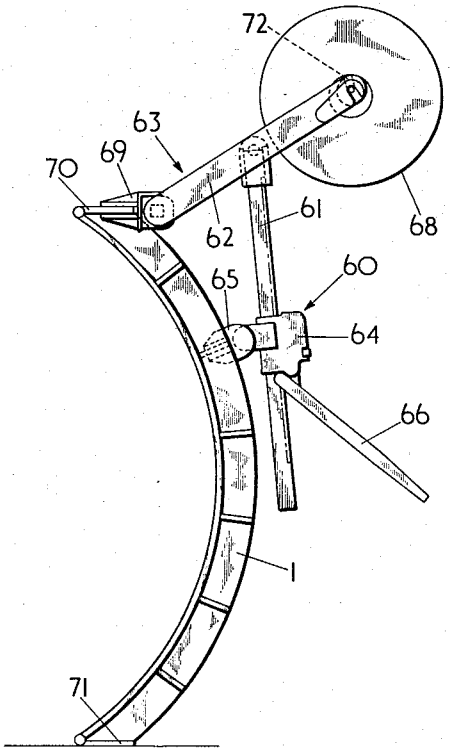
FIG. 6 is a side view of a third embodiment of equipment constructed in accordance with the present invention.

FIG. 6 shows a third embodiment of dispenser equipment constructed in accordance with the present invention and which differs mainly from the previously described first and second embodiments by the fact that the resilient coil spring means have been replaced by pawl and ratchet means 60 comprising a rigid rack 61 secured to an upwardly extending arm portion 62 of articulated arm means 63 and a box 64 including a spring loaded pawl (not shown) engagable with the rack 61 in well known manner. The box 64 is pivotally secured to the rear of the cowl 1 via a support bracket 65 and is provided with a pivotally mounted lever 66 adapted to selectively fixedly engage the rack 61 to urge the rack upwards relatively to the anchored box 64 tending to urge the arm means 62, 63 towards the newly exposed rock or mineral mine roof surface formed by a mining machine cutter such that in use as the mining machine traverses along the working face elongate material is dispensed from a store coil 68 and laid adjacent to the newly exposed rock or mineral surface.

The arm means 63 is fixedly secured to an horizontally extending flange 70 of the cowl 1 by an adapter 69 constituting support bracket means.

Upon the machine completing its traverse along the working face with the dispensing equipment mounted on the cowl flange 70, the dispensing equipment is detached from the cowl and then reattached to cowl flange 71 when the cowl is swung over to the opposite side of the rotary cutter in similar manner to that previously described with reference to the first embodiment. Alternatively, with a mining machine having leading and trailing rotary cutters the dispensing equipment is transferred from the cowl associated with the trailing cutter on the just completed traverse along the face to the other cowl associated with the trailing cutter on the next traverse to be made by the machine.

Operation of the third embodiment of dispensing equipment is similar to that previously described with reference to the first embodiment except that arm means and coil are urged towards the mine roof by the non-resilient pawl and ratchet means 60 instead of by resilient means, the pawl and ratchet means being sufficiently robust to withstand damage when pieces of broken rock or mineral fall from the mine roof. When loading the storage means provided by the arm portion 62, the arm portion is lowered by collapsing the pawl and ratchet means in well known manner. The coil 68 of elongate material is then placed in the upward extending slot 72 provided in each arm portion 62 before the lever is manually actuated to urge the rock 61 upwards relatively to the box 64 to urge the arm means and coil towards the mine roof.

FIGS. 7, 8, 9 and 10 relate to a fourth embodiment of dispensing equipment constructed in accordance with the present invention. As with the previously described embodiments the dispensing equipment is for mounting on the rear of a loading cowl 1 of a mineral mining machine having a rotary cutter and adapted to traverse to and fro along a working face in an underground mine with the rotary cutter winning mineral on each cutting traverse to newly expose a mine floor and roof.

Figure 7:
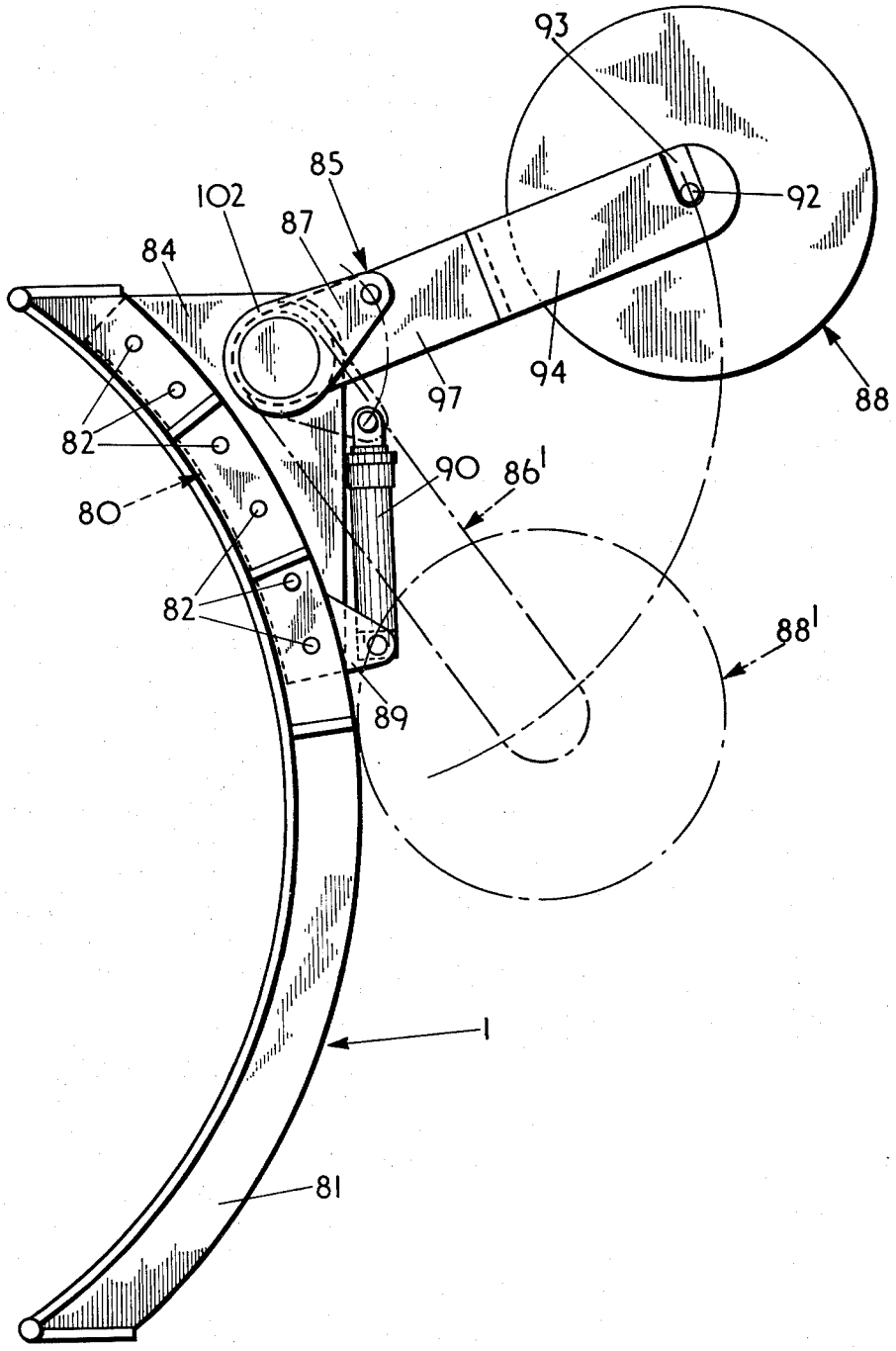
FIG. 7 is a side view of a fourth embodiment of equipment constructed in accordance with the present invention.
Figure 8:
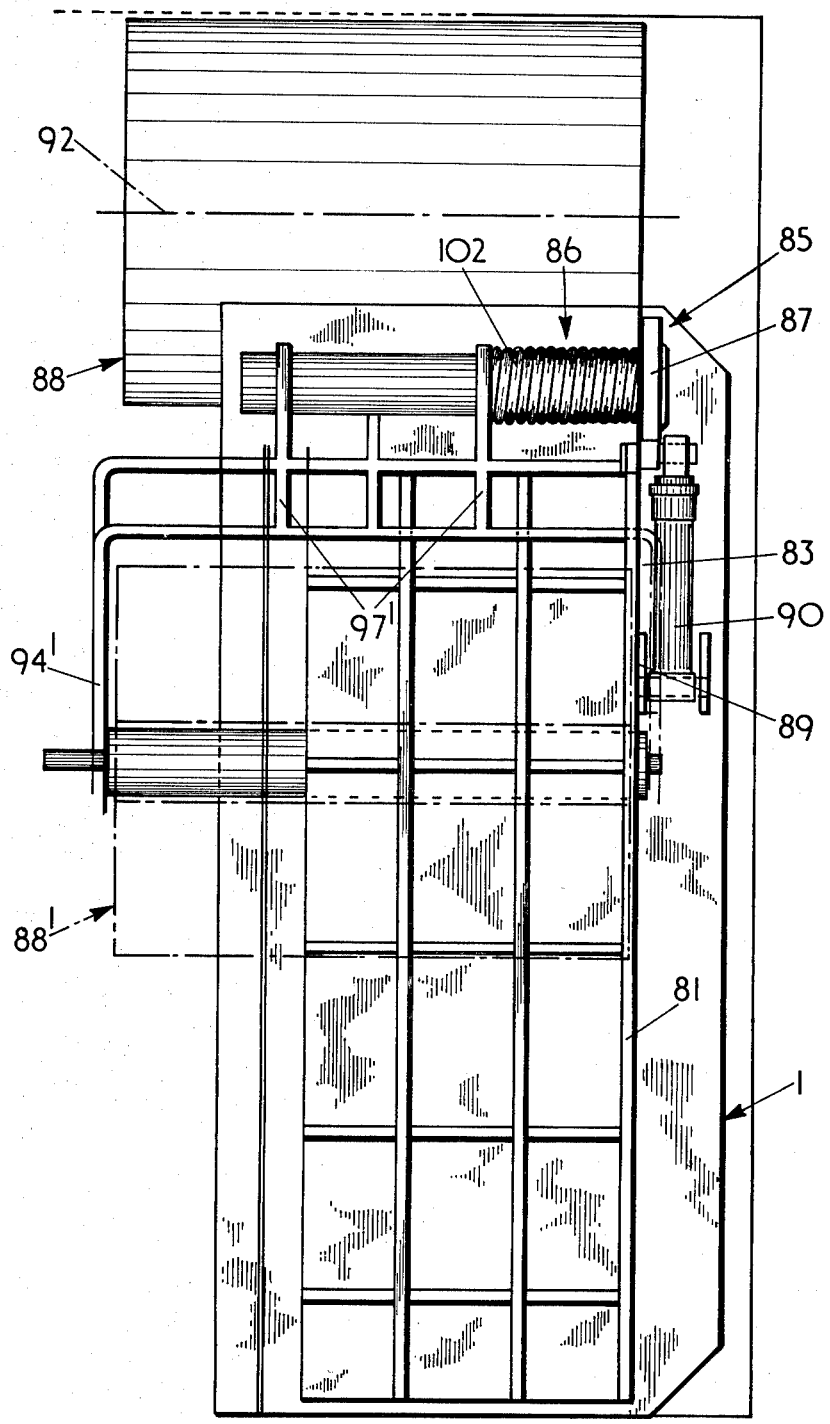
FIG. 8 is a rear end view of the equipment of FIG. 7.

In FIGS. 7 and 8 the dispensing equipment is shown in an operational position mounted on the loading cowl 1.

The fourth embodiment of dispensing equipment comprises support bracket means 80 fixedly secured to the uppermost rear portion of a vertically extending flange 81 of the cowl 1 by a plurality of bolts (not shown) engaged in a series of bolt holes 82. The support bracket means includes a vertically extending flange 83 co-operating with the coal flange 81 and a projection 84 of the flange 83 providing a pivotal mounting for arm means 85 comprising an arm assembly 86 constituting support means for a store coil 88 of elongate material. The arm means 85 also comprises a lug 87 resiliently mounted with respect to the arm assembly 86 which is connected to a further lug 89 provided on the support bracket means 80 by a fluid piston and cylinder arrangement 90 (shown in a lowered position in FIGS. 7 and 8 as will be described later in the specification) which when pressurised with fluid pressure for example hydraulic fluid pressure urges the arm means 85 towards the newly exposed rock or mineral surface formed by the mining machine cutter such that in use as the machine traverses along the working face elongate material is dispensed from the store coil 88 and laid adjacent to the newly exposed rock or mineral surface.

The piston of the piston and cylinder arrangement 90 can be lowered (to the position shown in FIGS. 7 and 8) from its normal operating position to allow the arm assembly 86 to be lowered to a position as indicated at 86' to permit a new coil 88' of elongate material to be loaded into the storage means including an axle 92 engagable in an upwardly extending slot 93 provided in each arm 94 of the arm assembly 86.

Figure 10:
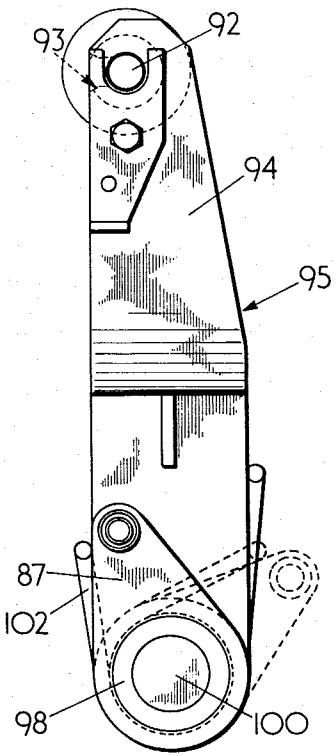
FIG. 10 is a side view of a detail of FIG. 7 shown on an enlarged scale.
Figure 9:
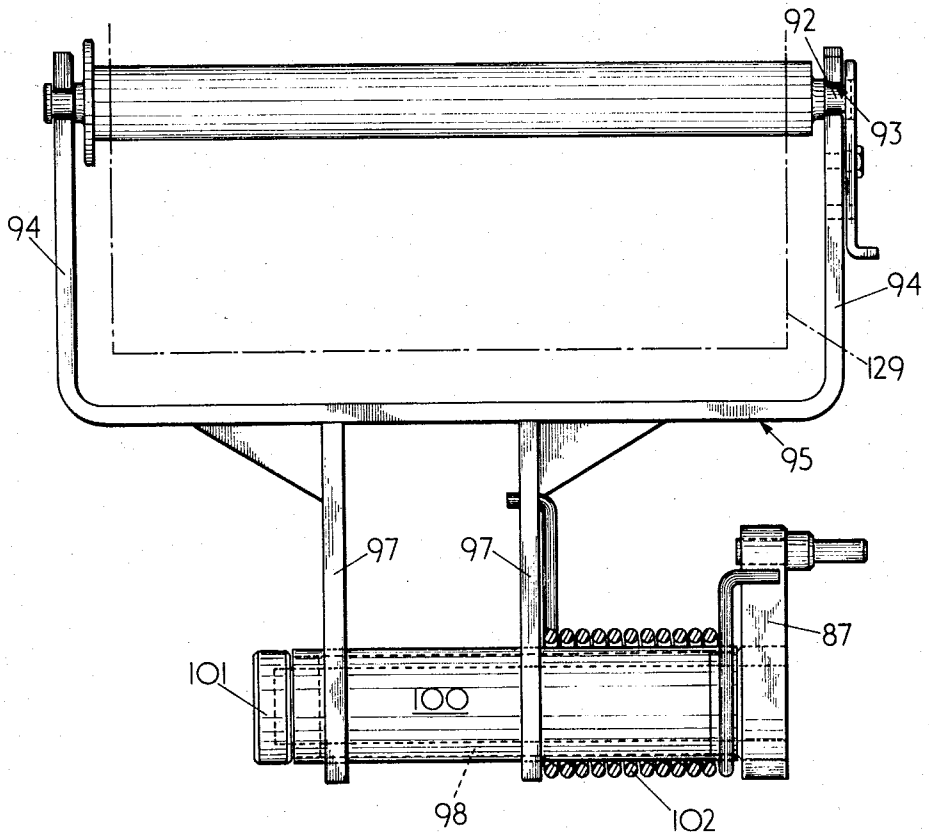
FIG. 9 is a plan of the equipment of FIG. 7 shown on an enlarged scale.

The arm means 85 now will be described with particular reference to FIGS. 9 and 10 which show the arm assembly 86 to include a generally 'U'-shaped formation 95 the limbs of which constitute the two previously mentioned arms 94. The generally 'U'-shaped formation 95 is carried on two arm members 97 fixedly secured to a rigid tube component 98 which rotatably accommodates a shaft 100 fixedly supporting the lug 87 and retained within the tube component by an end cap 101. The end of the lug remote from the tube component carries a spigot for engagement by the piston and cylinder arrangement. A resilient coil spring 102 wound around the tube component 98 is arranged to act between one of the arm members 97 and the lug 87, the two end portions of the spring abutting opposing surfaces on the arm member 97 and lug 87 respectively.

Thus, in use when the piston and cylinder arrangement is urging the arm assembly towards the mine roof the resilient action of the spring 102 permits a limited amount of floating of the arm assembly to occur to accommodate for fluctuations in the mine roof or for the action of pieces of broken rock or mineral falling from the mine roof onto the dispensing equipment.

Once the piston on cylinder arrangement has urged the coil and arm means towards the mine roof the operation of the dispensing equipment is similar to that previously described with reference to the earlier described embodiment.

Figure 11:
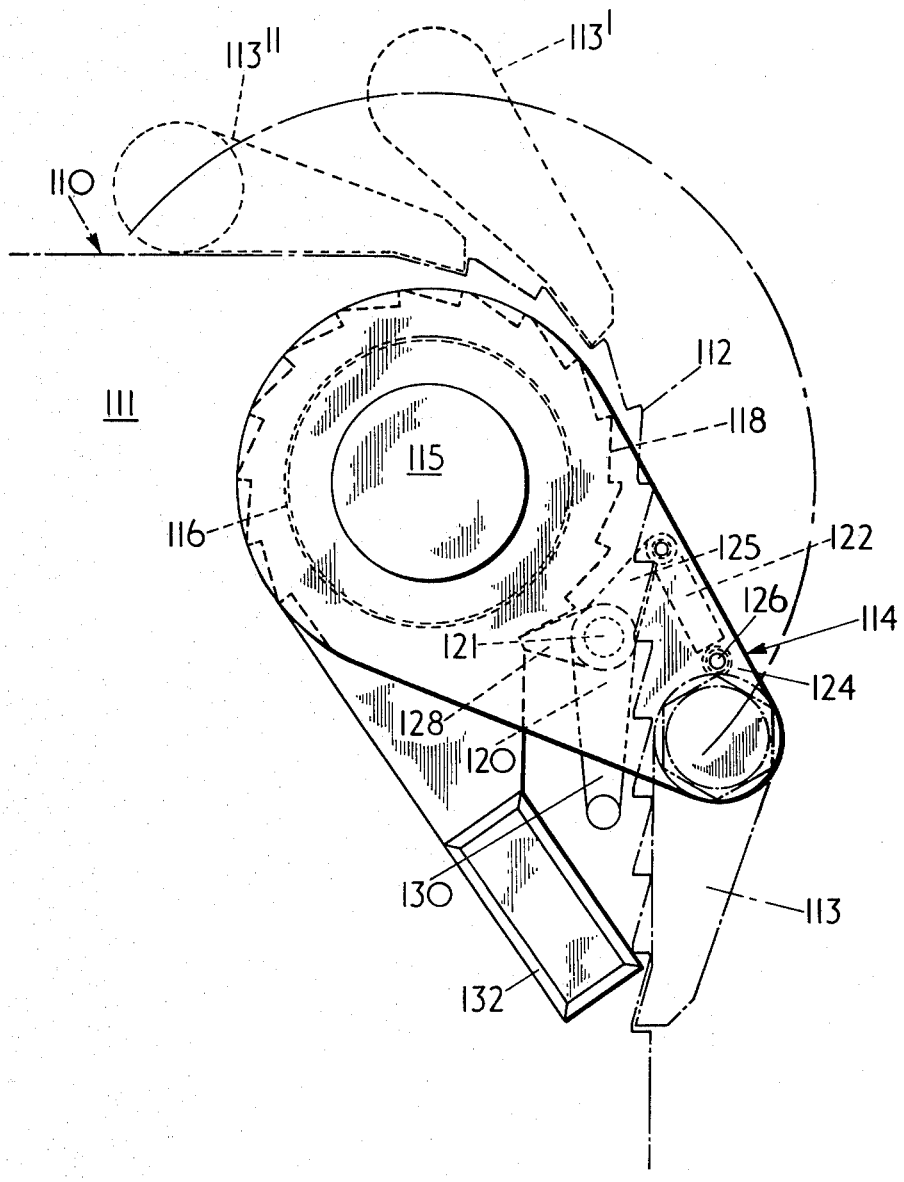
FIG. 11 is an incomplete side view of a part of a fifth embodiment of equipment constructed in accordance with the present invention.
Figure 12:
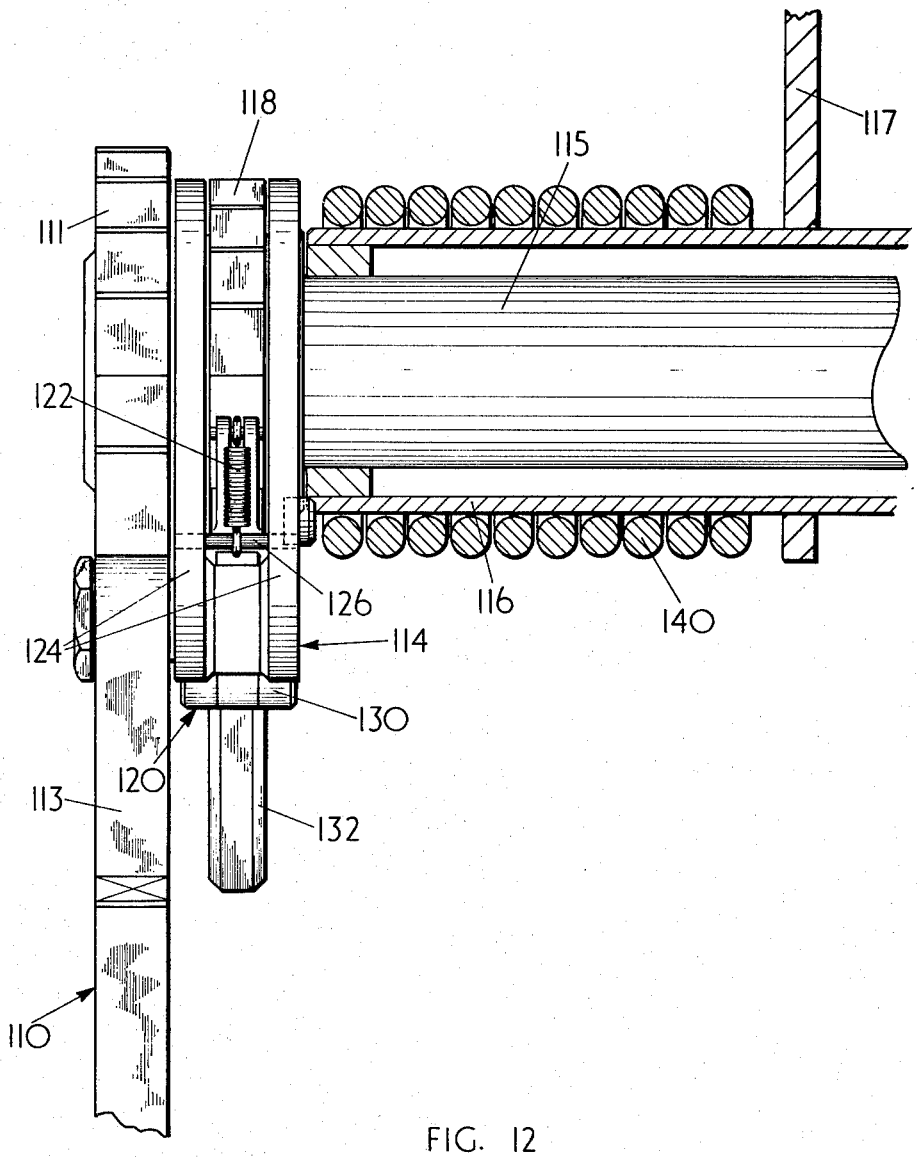
FIG. 12 is an incomplete rear end view, partly in section, of the part of the equipment of FIG. 11.

FIGS. 11 and 12 show a part of a fifth embodiment of dispensing equipment constructed in accordance with the present invention. Typically the part in FIGS. 11 and 12 of the drawings would replace the piston and cylinder arrangement of the fourth embodiment previously described with reference to FIGS. 7, 8, 9 and 10, the remaining part of the fifth embodiment which is not shown in FIGS. 11 and 12 being substantially as described with reference to the fourth embodiment.

In FIGS. 11 and 12, the dispensing equipment comprises support bracket means in the form of a generally triangular shaped adaptor 110 (only two sides of which are shown in FIG. 11) which is secured to a loading cowl (not shown) by a row of bolts extending along the third side of the adaptor which is not shown in the drawings, the securing arrangement being similar to that previously described with reference to the fourth embodiment as shown in FIGS. 7 and 8. The adaptor includes a projection 111 defining a curved toothed rack 112 extending along the two sides of the adaptor shown in FIG. 11, the rack being engagable by a pawl 133 pivotally mounted on a projection assembly 114 mounted on a shaft 115 fixed with respect to the projection 111 and rotatably supporting a tube component 116 which in turn carries arm means 117 (only a portion of which is shown in FIG. 12) in similar manner to the previously described tube component and arm means of the fourth embodiment.

Throughout the movement of the projection assembly 114 the pawl 113 is urged by gravity into engagement with the rack 112.

The fifth embodiment of dispensing equipment also includes a second pawl and ratchet arrangement comprising a ratchet 118 constituting part of the projection assembly 114 and rotatably mounted with respect to the remainder of the projection assembly 114 comprising two arm elements 125 located on opposite sides of ratchet 118 (see FIG. 12) and a spring biassed generally 'T'-shaped pawl 120 pivotally mounted on the projection assembly 114 between the two arm elements 124 to engage the teeth of the ratchet 118. One limb 125 of the 'T'-shaped pawl 120 is connected to one end of a coil spring 112, the other end of the spring being anchored to the projection assembly 114 by a pin 126 secured between the two arm elements 124, the spring bias urging the nose limb 128 of pawl 120 into engagement with this ratchet 118. The third limb 130 of the 'T' shaped pawl 120 provides a manually operable handle for releasing the pawl.

The projection assembly 114 also comprises a socket 132 integral with the ratchet 118, the socket constituting engagement means for a lever (not shown) enabling an operator to raise the dispensing equipment towards a mine roof as will be described later in this specification.

The dispensing equipment also comprises a coil spring 140 wound around the tube component 115 and the ends (not shown in FIG. 9) of which abut opposed surfaces of the arm means 117 and the projection assembly 114, respectively, tending to urge the arm means 117 together with a coil of elongate material 129 (only shown in FIG. 9) towards the mine roof.

In use, with the arm means 117 in its lowermost position a coil of elongate material is loaded onto the arm means in similar manner to that previously described with reference to the fourth embodiment.

Once the arm means are loaded the operator engages a lever in the socket 132 and urges the ratchet 118 to rotate in an anticlockwise direction as seen in FIG. 11. As the pawl 120 is fixedly engaged in the racket 118 the arm elements 124 of the projection assembly 114 are rotated anti-clockwise with the ratchet 118, the pawl 113 being moved along the ratchet 112 until movement of the lever is halted when it approached the vicinity of the mine roof.

The lever is then lowered slowly until the pawl 113 engages in the ratchet 112 to retain the dispensing equipment in the partly raised position. With the pawl 120 sliding over the ratchet 118 the lever is lowered to the mine floor. The pawl 120 then re-engages with the ratchet 118 under its spring bias and the lever once again raised to the vicinity of the mine roof. The above described procedure is repeated two or three times until the dispensing equipment is raised sufficiently with the coil of elongate material adjacent to the mine roof. The pawl 113 is indicated in two engaged positions 113' and 113'' associated with the different stages of raising the arm means 117 to the mine roof.

The machine then traverses along the working face with the dispensing equipment laying a layer of elongate material adjacent to the mine roof, the layer being retained adjacent to the mine roof by roof supports which are advanced immediately following the passage of the machine and/or by securing the edge of the elongate material to the adjacent edge of the previously laid layer of elongate material.

As the machine traverses along the working face any undulation in the mine roof is negotiated by the effect of the coil spring 140 which tends to maintain the coil of elongate material in contact with the mine roof.

When the machine approaches the end of its traverse along the working face, the arm means 117 is lowered from the mine roof in stages by repeatedly manually releasing the pawls 113 and 120 from the ratchets 112 and 118, respectively, and lowering the lever and socket 132.

From the above description it will be seen that the present invention provides simple robust and reliable equipment for dispensing a layer of elongate material, for example, wire mesh or wire mesh with a sheet backing, adjacent to a mine roof, the equipment being mounted on the rear of a loading member associated with a rotary cutter.

We claim:

1. Equipment for laying a layer of elongate material adjacent to a newly exposed rock or mineral surface formed by a mining machine cutter as the machine traverses along the working face, a loading member for cut rock or mineral being positioned adjacent to the rear of the cutter, comprising support bracket means fixedly securable to the loading member, arm means pivotally mounted on the support bracket means and constituting support means for a store of elongate material, and means for urging the arm means towards said newly exposed rock or mineral surface formed by the mining machine cutter such that in use as the machine traverses along the working face elongate material is dispensed from the store and laid adjacent to the newly exposed rock or mineral surface.

2. Equipment as claimed in claim 1, in which said means for urging the arm means towards said newly exposed rock or mineral surface comprises resilient means.

3. Equipment as claimed in claim 1, in which said means for urging the arm means towards said newly exposed rock or mineral surface comprises a pawl and ratchet mechanism.

4. Equipment as claimed in claim 1, in which said means for urging the arm means towards the newly exposed rock or mineral surface comprises a piston and cylinder arrangement.

5. Equipment as claimed in claim 1, in which said means for urging the arm means towards the newly exposed rock or mineral surface acts between the support bracket means and the arm means.

6. Equipment as claimed in claim 1, in which said means for urging the arm means towards the newly exposed rock or mineral surface acts between the arm means and further support bracket means fixedly securable to the loading member at a location remote from the first mentioned support bracket means.

* * * * *